US005494065A

United States Patent [19]

Kuo et al.

[11] Patent Number: 5,494,065

[45] Date of Patent: Feb. 27, 1996

[54] POWERFUL STRUTTING ACTION UMBRELLA FRAMEWORK

[76] Inventors: Cheng M. L. Kuo, No. 18, Alley 15, Lane 582, Sea Ta Road, Hsinchu; Shen H. Wang, No. 75, Ann Mei Road, Kon Kaung Village, Ho Li, Taichung, both of Taiwan

[21] Appl. No.: 214,542

[22] Filed: Mar. 18, 1994

[51] Int. Cl.[6] ..... A45B 19/00

[52] U.S. Cl. ..... 135/31; 135/32; 135/37; 135/253; 135/908

[58] Field of Search ..... 135/31, 32, 37, 135/908, 25.3

[56] References Cited

U.S. PATENT DOCUMENTS

| | | | |
|---|---|---|---|
| 3,780,748 | 12/1973 | Weber | 135/25.3 |
| 3,848,740 | 11/1974 | Weber | 135/25.3 |
| 4,030,514 | 6/1977 | Schultes | 135/25.3 |
| 4,676,262 | 6/1987 | Yang | 135/25.3 |
| 5,048,550 | 9/1991 | Su | 135/23.3 |
| 5,235,998 | 8/1993 | Liu | 135/25.3 |
| 5,370,144 | 12/1994 | Yang | 135/31 |

FOREIGN PATENT DOCUMENTS

| | | | |
|---|---|---|---|
| 2234939 | 1/1974 | Germany | 135/25.3 |

*Primary Examiner*—Wynn E. Wood

*Attorney, Agent, or Firm*—Morton J. Rosenberg; David I. Klein

[57] ABSTRACT

An improved umbrella framework having a powerful strutting action is provided. The umbrella framework includes a strut frame member situated at the underside of a first umbrella frame member. The outer end of the strut frame member is connected to the outer end of a second umbrella frame member. The center of the strut frame member is connected to a support strut and the inner end is connected to a center guide. The center guide is installed onto the umbrella pole between a positioning ring and an upper guide. A sliding guide is disposed on the umbrella pole below the positioning ring. The sliding guide is operated to open the umbrella, whereupon the support strut effectively actuates the movement of the commonly connected strut frame member, the second umbrella frame member and the tail umbrella frame member.

1 Claim, 4 Drawing Sheets

POWERFUL STRUTTING ACTION UMBRELLA FRAMEWORK

BACKGROUND OF THE INVENTION

This invention is directed to an improved structure umbrella framework having a powerful strutting action. Specifically, this invention is directed to a design which is an improvement over conventional multi-jointed collapsible umbrella frameworks through the utilization of a strut frame member connected to a center guide. That arrangement enables the construction of an umbrella framework having a powerful strutting action.

The framework of conventional multi-jointed collapsible umbrellas is typically comprised of first, second and tail umbrella frame members and utilize a sliding guide to cause the movement of the umbrella framework to accomplish the opening and closing functions of the umbrella. Since there is only a single strutting force type of umbrella framework, the strength of the entire umbrella framework is inadequate, as demonstrated when a strong gust of wind deforms the umbrella and results in extreme user frustration and inconvenience.

To enable a fuller understanding of the novel structure, innovative features and practicality of the invention, the following drawings and detailed description have been provided.

DETAILED DESCRIPTION OF THE PREFERRED EMBODIMENT

Figure 1:
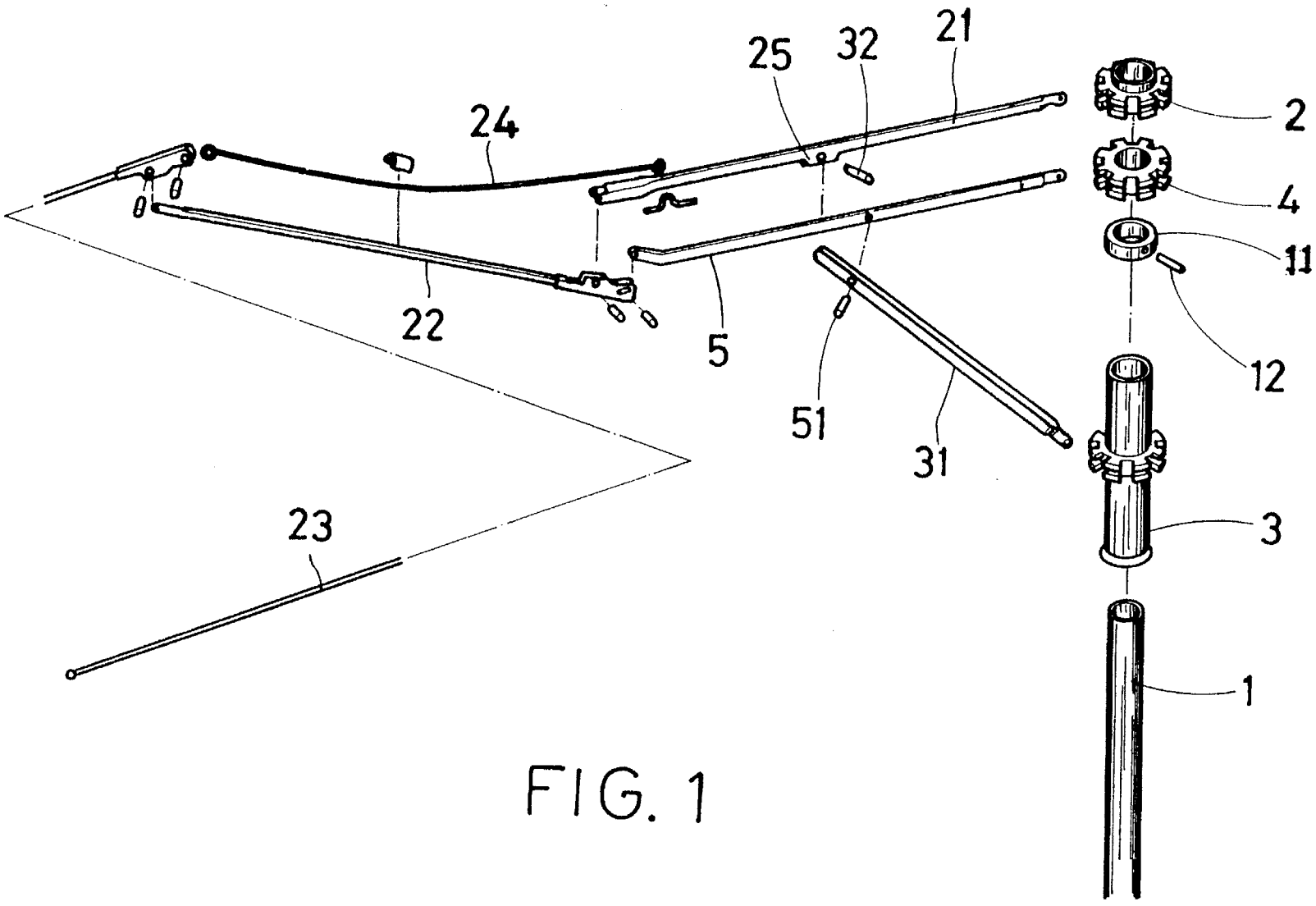
FIG. 1 is an exploded perspective view of the structure of the present invention.
Figure 2:
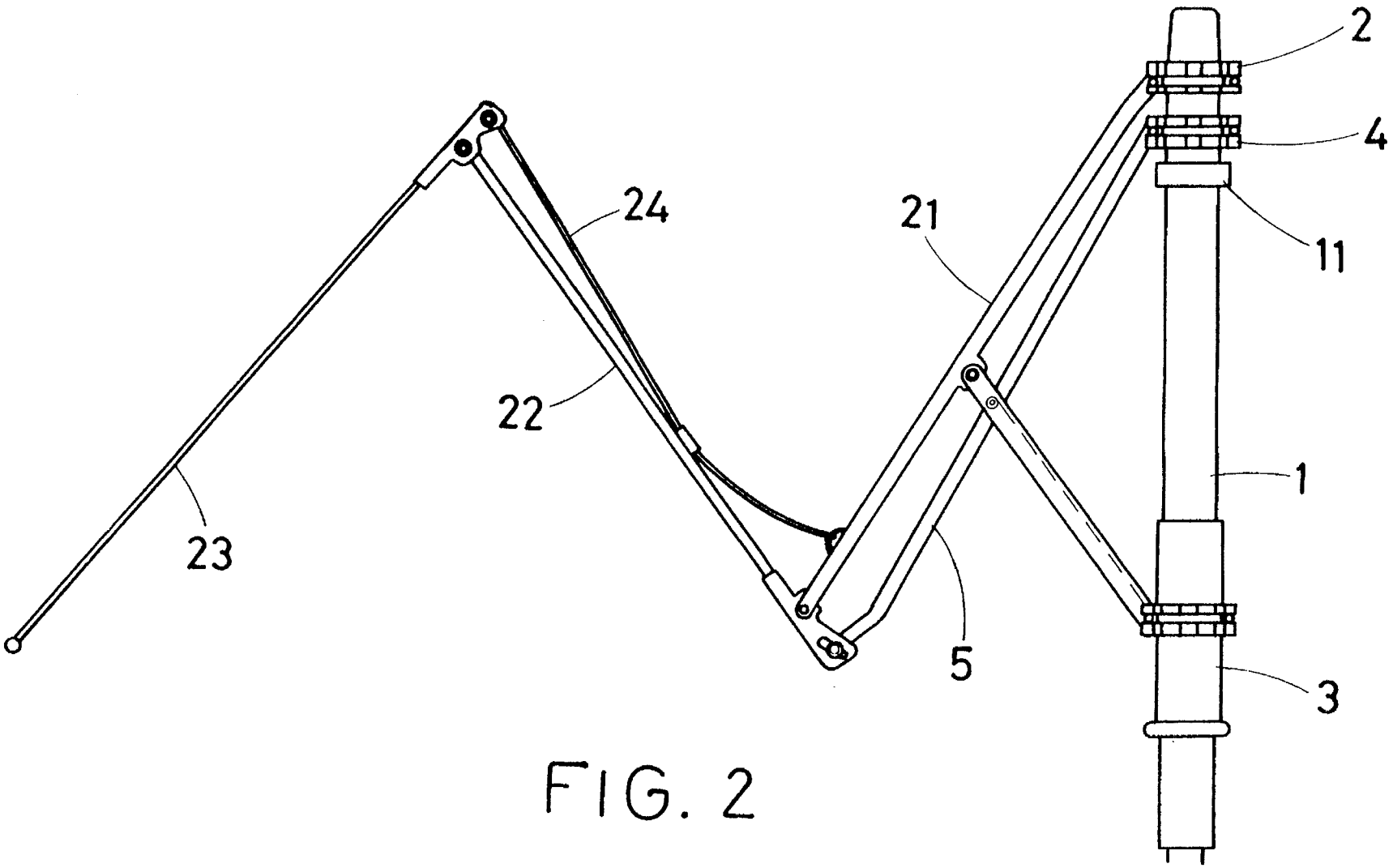
FIG. 2 is an elevation view of the present invention.

As indicated in FIG. 1 and FIG. 2, the umbrella framework of the invention herein includes a conventional center pole 1, an upper guide 2 and a sliding guide 3. A first umbrella frame member 21 is connected to and extends outward from the upper guide 2. The second umbrella frame member 22 extends from the first umbrella frame member 21, and the tail umbrella frame member 23 extends from the second umbrella frame member 22. Positioned on the second umbrella frame member 22 is a flexible frame member 24. Further, a support strut 31 is connected to and extends outward from the sliding guide 3, the outer end of the support strut 31 being connected to the tabs 25 located at the center of the first umbrella frame member 21, and secured thereto by the insertion of a pin 32. The aforementioned structural parts and assembly configuration comprise the fundamental structure of a conventional manually operated folding umbrella and, therefore, shall not be discussed further. The innovative features of the instant invention includes the provision of a strut frame member 5, having an inner end connected to a center guide 4 and a center section connected to the support strut 31 and secured by a pin 51. The outer end of strut frame member 5 is connected to the inner end of the second umbrella frame member 22. Installed onto the center pole 1 is a positioning ring 11 that is secured by a pin 12. The positioning ring 11 is disposed between the sliding guide 3 and the upper guide 2, while the center guide 4 is disposed between the positioning ring 11 and the upper guide 2, thereby permitting the sliding guide 3, the upper guide 2 and the center guide 4 to slide on the center pole 1.

Figure 3:
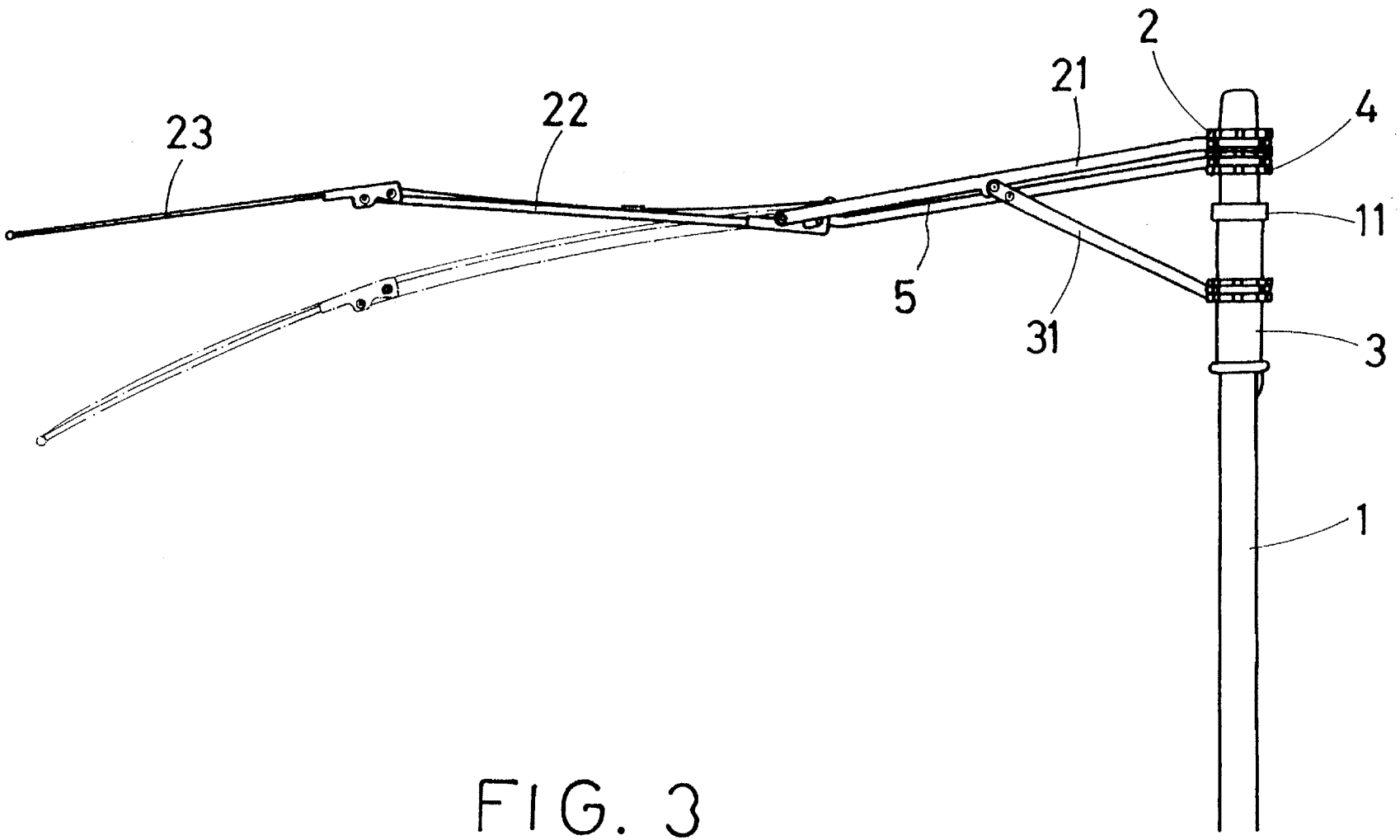
FIG. 3 is an elevation view of the present invention when the umbrella is opened; and, FIG. 4 is an elevation view of the present invention when the umbrella is closed.
Figure 4:
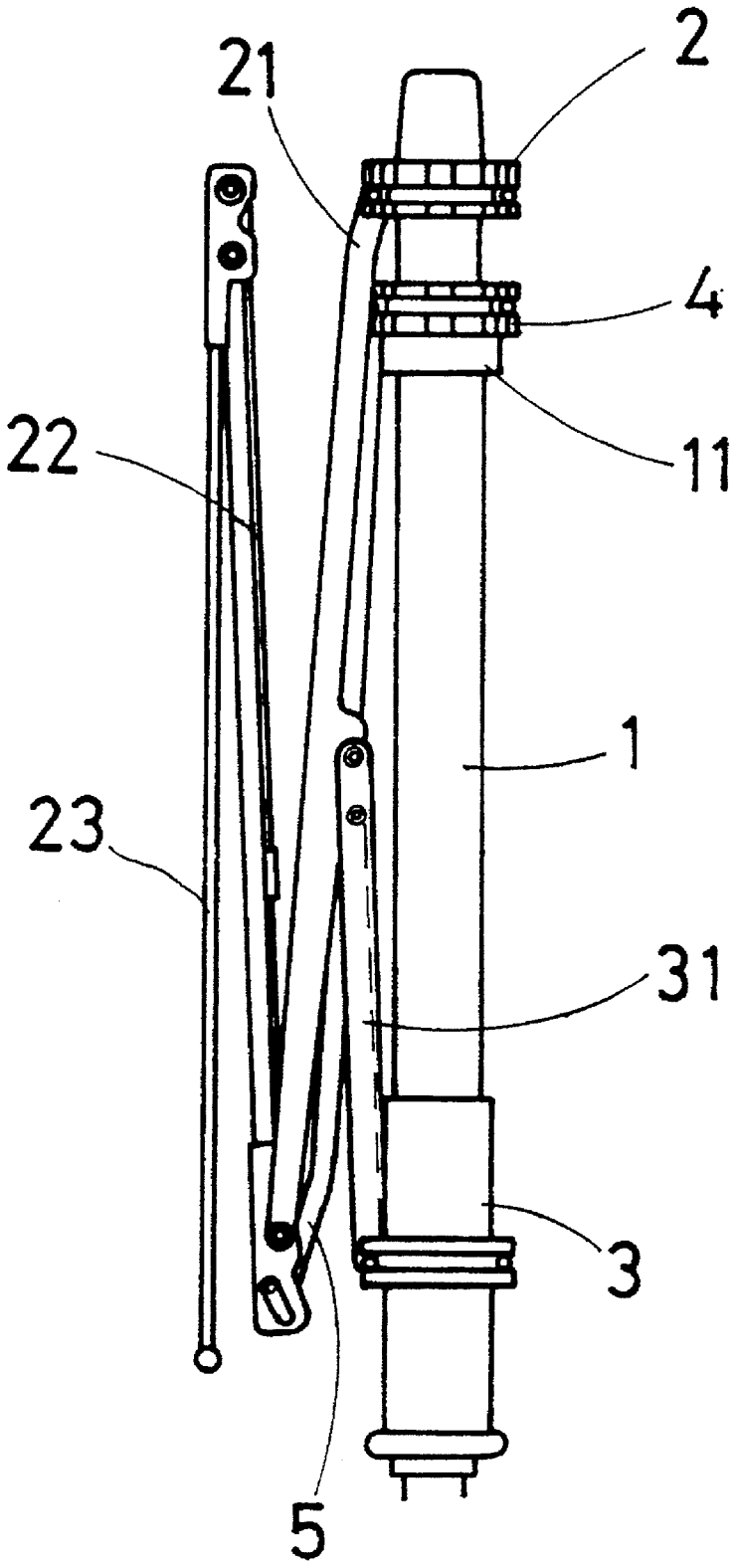

As indicated in FIG. 3 and FIG. 4, when the umbrella is closed, the sliding guide 3 is utilized to operate and control the movement of the entire umbrella framework. As shown in FIG. 3, when the umbrella is opened, the upper end of the sliding guide 3 is moved against the positioning ring 11 and the center guide 4 is moved against the underside of the upper guide 2. Due to the action of the support strut 31, as the umbrella is opened, the outer end of the support strut 31 rises upward and transfers a powerful actuating force to the second umbrella frame member 22 and the tail umbrella frame member 23, thereby providing an improvement over the shortcomings of conventional umbrellas by predictably increasing the practical effectiveness of the umbrella framework. After the umbrella is closed, the center guide 4 returns to the top of the positioning ring 11 and the strut frame member 5 is situated at the inner side of the first umbrella frame member 21 and, as indicated in FIG. 4, can be compactly stored in a small area.

In summation, since the structure of the invention herein is original and offers a kind of umbrella framework that has a powerful strutting action that is an improvement over the shortcomings of conventional umbrellas and thereby ensures full practical effectiveness, the invention herein complies with the requirements of an innovativeness, originality and practicality and should be eligible for the granting of patent rights, wherein the application thereof is hereby submitted.

What is claimed is:

1. An umbrella framework having a powerful strutting action, comprising:

a longitudinally extended center pole member;

an upper guide coupled to one end of said center pole member;

a first frame member having a pair of opposing ends, said first frame member having a first end pivotally coupled to said upper guide;

a second frame member having a pair of opposing ends, said second frame member having a first end pivotally coupled to a second end of said first frame member;

a tail frame member having an inner end pivotally coupled to a second end of said second frame member;

a flexible frame member having a first end pivotally coupled to said inner end of said tail frame member and an opposing second end pivotally coupled to said first frame member adjacent said second end thereof;

a positing ring longitudinally spaced from said upper guide and affixed to said center pole member;

a center guide slidably disposed on said center pole member between said positioning ring and said upper guide;

a strut frame member having a first end pivotally coupled to said center guide and an opposing second end pivotally coupled to said first end of said second frame member;

a sliding guide member slidably positioned on said center pole member in longitudinally spaced relationship from both said upper guide and said positioning ring, said sliding guide member being displaceable from a first position where said umbrella framework is in a closed condition to a second position adjacent said positioning ring where said umbrella framework is in an open condition; and, a support strut member having a first end pivotally coupled to said sliding guide member and an opposing second end pivotally coupled to said first frame member intermediate said first and second ends of said first frame member, said support strut member being pivotally coupled to a central portion of said strut frame member at a location adjacent said support strut member second end for rotatively displacing both said first frame member and said strut frame member responsive to displacement of said sliding guide member to rapidly open and close said umbrella framework.

* * * * *